US005503436A

United States Patent [19]

Alpaugh et al.

[11] Patent Number: 5,503,436

[45] Date of Patent: Apr. 2, 1996

[54] ATM DISPENSABLE SELF-ADHESIVE POSTAGE STAMP CONSTRUCTION

[75] Inventors: Kathy Alpaugh, Concord, Ohio; Robert Birnbaum, Redlands, Calif.; Kent Fung, Bethlehem, Pa.; Alan Green, Simpsonville, S.C.; James Macuga, Concord; Scott Mingus, Mentor, both of Ohio; Patricia P. Padilla, Ontario, Calif.; Joseph Y. Peng, Washington, D.C.; Alim A. Fatah, Washington, D.C.; Rajendra Kumar, Washington, D.C.

[73] Assignee: United States Postal Service, Washington, D.C.

[21] Appl. No.: 90,283

[22] Filed: Jul. 12, 1993

Related U.S. Application Data

[63] Continuation of Ser. No. 912,317, Jul. 13, 1992, abandoned.

[51] Int. Cl.[6] ..... G09F 3/00

[52] U.S. Cl. ..... 283/71; 283/81; 283/94; 283/101; 428/42

[58] Field of Search ..... 283/71, 81, 94, 283/101; 428/42, 33, 55, 56, 50

[56] References Cited

U.S. PATENT DOCUMENTS

| | | | |
|---|---|---|---|
| 2,300,787 | 11/1942 | Ingliss . | |
| 3,028,280 | 4/1962 | Hoffman . | |
| 3,592,326 | 7/1971 | Zimmerie . | |
| 4,264,366 | 4/1981 | Peng | 106/22 |
| 4,876,131 | 10/1989 | Ashby et al. | 281/5 X |
| 4,895,747 | 1/1990 | Birkholz et al. | 428/42 |
| 4,952,433 | 8/1990 | Tezuka et al. | 281/5 X |
| 5,042,842 | 8/1991 | Green et al. | 283/81 X |
| 5,141,789 | 8/1992 | Matsuzawa et al. . | |
| 5,154,974 | 10/1992 | Norman et al. . | |
| 5,296,279 | 3/1994 | Birnbaum et al. | 283/71 X |
| 5,344,190 | 9/1994 | Volz | 283/71 |

FOREIGN PATENT DOCUMENTS 1414777 11/1975 United Kingdom .

*Primary Examiner*—Frances Han
*Attorney, Agent, or Firm*—Christie, Parker & Hale

[57] ABSTRACT

There is provided a postage stamp construction formed of a plurality of postage stamps adhered to a currency sized release liner by an ooze resistant pressure sensitive adhesive which construction coated with a polymeric coating of the face of the stamp and the undersurface of the release liner and dispensable from an automatic teller machine.

28 Claims, 3 Drawing Sheets

Fig. 1
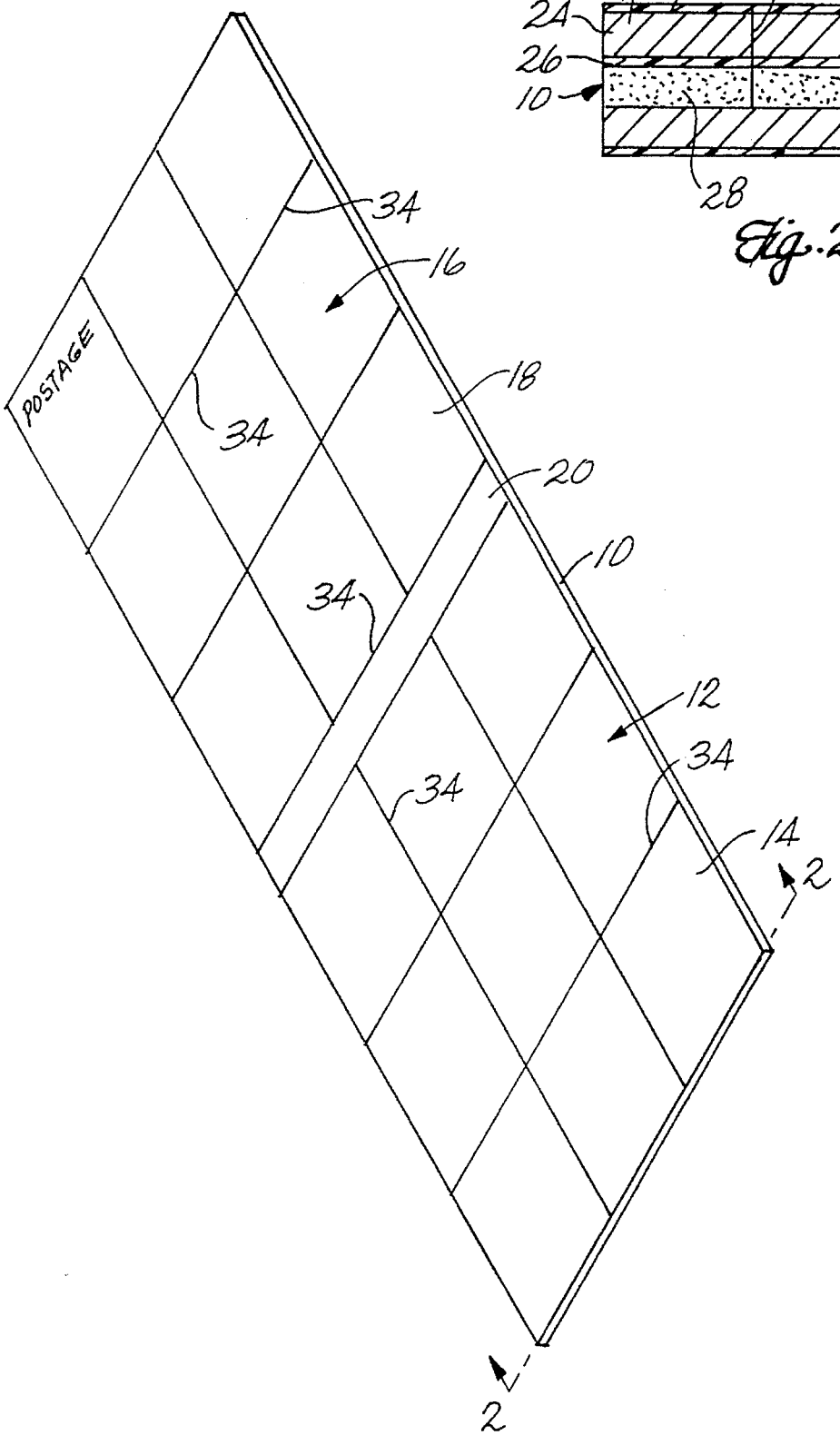
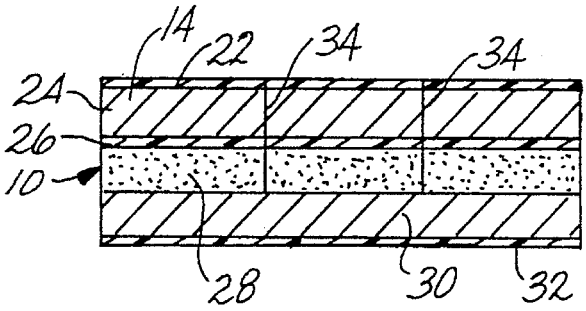
Fig. 2

ATM DISPENSABLE SELF-ADHESIVE POSTAGE STAMP CONSTRUCTION

CROSS REFERENCE TO RELATED APPLICATION

This application is a continuation of application Ser. No. 07/912,317 filed Jul. 13, 1992 now abandoned.

FIELD OF THE INVENTION

This invention is directed to an array of self-adhesive postage stamps presented on a currency sized release liner to form an assembly that is dispensable from an automatic teller machine or ATM.

BACKGROUND OF THE INVENTION

Various postage services have determined that it would be convenient to serve the public with means to purchase postage stamps through an automatic teller machine or ATM.

The postage stamp itself is a rather complex device. To meet current user demands it must be constructed of a face material or backing capable of accepting high quality printing of complex design stable under a variety of environmental conditions and provide an ink cancelable surface, on which cancellation ink dries rapidly, and which is removable from its adhesive to meet the needs of stamp collectors. In addition to being cancelable it should have at its surface means to detect the stamp so that a properly stamped envelope can be cancelled in an automated cancellation machine.

Traditionally, a postage stamp has been manufactured with a water soluble adhesive. It has been the desire of the postal service to, no only convert the adhesive to a self-adhesive or pressure sensitive adhesive, but to also present the postage stamps, as part of a laminate construction, which is dispensable from an automatic teller machine.

An automatic teller machine is designed to dispense currency. Any postage stamp construction to be dispensable must be dispensable as a laminate of an array of stamps serving as the facestock or backing, an interlayer of a self- or pressure-sensitive adhesive and a continuous release liner which protects the adhesive until the stamps are peeled therefrom and still provide performance characteristics which simulate the currency from which the ATM was configured to dispense.

No characteristic of the classic postage stamp can be sacrificed, yet the laminate must behave like currency in an automatic teller machine, otherwise the ATM will not dispense the product.

The first attempt at an automatic teller machine dispensable stamp construction consisted of an array of postage stamps formed of a taggant coated polyester laminated to an acrylic based adhesive which was in turn laminated to a polyester based release liner. This arrangement did not meet with public acceptance in the United States. The reason was attributed to the environmentally unfriendly nature of its polyester facestock.

A second version featured a 45 pound clear overcoated paper facestock and paper release liner. Because of several problems, including thickness of the construction and tendency of the adhesive to edge ooze, the second version could not be reliably dispensed from an automatic teller machine, and was predominantly sold over the counter.

The third version was identical to the second version but uncoated. Although sold through ATM's on a limited basis it did dispense reliably.

We have sought to overcome the problems of our prior constructions by providing a postage stamp construction which would reliably dispense from an ATM and offer high quality postage stamps that would meet the needs of stamp collectors.

SUMMARY OF THE INVENTION

According to the present invention there is provided an automatic teller machine dispensable postage stamp construction which comprises a sheetlet consisting of an array of postage stamps adhered by an ooze resistant pressure sensitive adhesive to a continuous release liner of currency size. The stamps comprising paper facestock are of a paper weight of about 56 gm/m$^2$ having an upper and lower surface. The upper surface is printed with stamp graphics and coated having a surface coefficient of friction greater than 0.45. The coating preferably contains Taggant with an imprintable polymeric coating. The lower surface is coated with a water soluble primer.

The water soluble primer is in contact with ooze resistant pressure sensitive adhesive, which is in turn, in contact with the release liner which has an undercoating. Release liner paper weight is about 50 gms/m$^2$.

In the preferred construction Taggant, a zinc orthosilicate, is contained in the top coat and provided in an amount sufficient to enable automatic location of a postage stamp on an envelope for cancellation purposed. Any other means of stamp detection can be used.

The overcoating and the undercoating of the paper serves to cooperate to stiffen the construction, to provide a quasi seal and reduce or eliminate changes in paper dimension with changes in humidity which results in a reduced tendency for edge ooze to occur. The relative frictional characteristics between slip of the surfaces undercoating further prevent the dispensing of multiple stamp sheetlets. Edge ooze is also controlled by choice of an adhesive which has a storage modulus greater than 10,000 dynes/cm$^2$ at a deformation rate of $10^{-7}$ radian per second.

The overall thickness of the construction, and presently preferred construction for the United States market, is a sheetlet which is rectangular in shape, having a width of 2.61", a length of 6.125" with each stamp having a width of 0.87" and a length of 0.982". It will be understood that dimensions are controlled by the number of stamps contained on the sheetlet and local overall currency dimensions.

It is required that the assembly of multiple stamps on a release liner of currency size have a curl radius in any direction of less than 40 mm and an overall construction thickness between about 4.3 and about 5 mils, preferably about 4.6 mils for purposes of simulating United States currency.

BRIEF DESCRIPTION OF THE DRAWINGS

FIG. 1 is a perspective view of the preferred stamp construction sheetlet of the instant invention.

FIG. 2 is a cross sectional exaggerated view of the stamp sheetlet construction of the instant invention.

DETAILED DESCRIPTION

Figure 3:
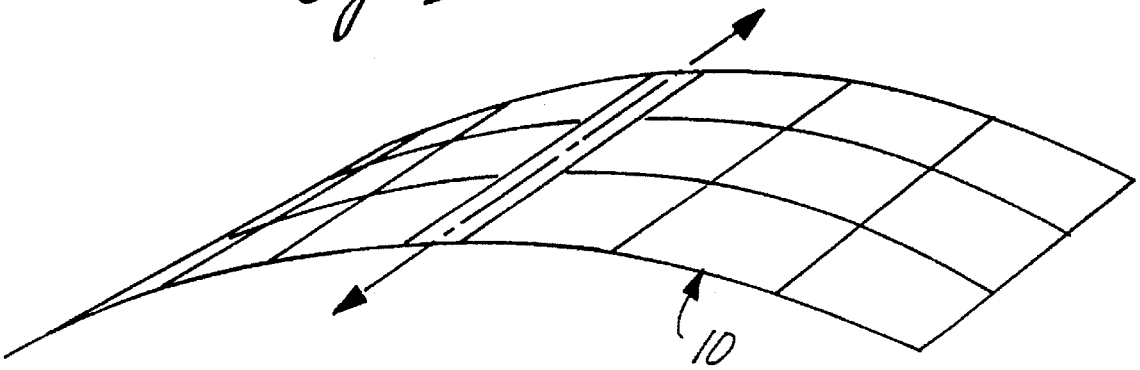
FIG. 3 illustrates short axis curl.

With reference to the Drawing FIG. 1 illustrates the presently preferred stamp sheetlet construction of the instant invention, while FIG. 2 depicts an exaggerated view of the cross section of the construction of FIG. 1.

With reference to FIGS. 1 and 2, the preferred stamp sheetlet construction 10 consists of a first array 12 of stamps 14, preferably 9 in number and a second array 16 of stamps 18 also, as shown 9 in number, with 3 stamps 14 of the first array and 3 stamps 18 of the second array 16 being contiguous to a removable bar 20. The removable bar 20 serves to assist until removed, in the sheetlet behaving like currency, as the region for a postal service to add identification information and is removable to allow the sheetlet to be folded in half to depict a booklet of stamps for insertion in a pocket or other holder. Prior to removal, the sheetlet provides in cooperation with the stamps but independent therein uniform opacity. This provides sheetlet of uniform opacity to enable dispensing from ATM machines which detect possible multiple dispenses.

Figure 4:
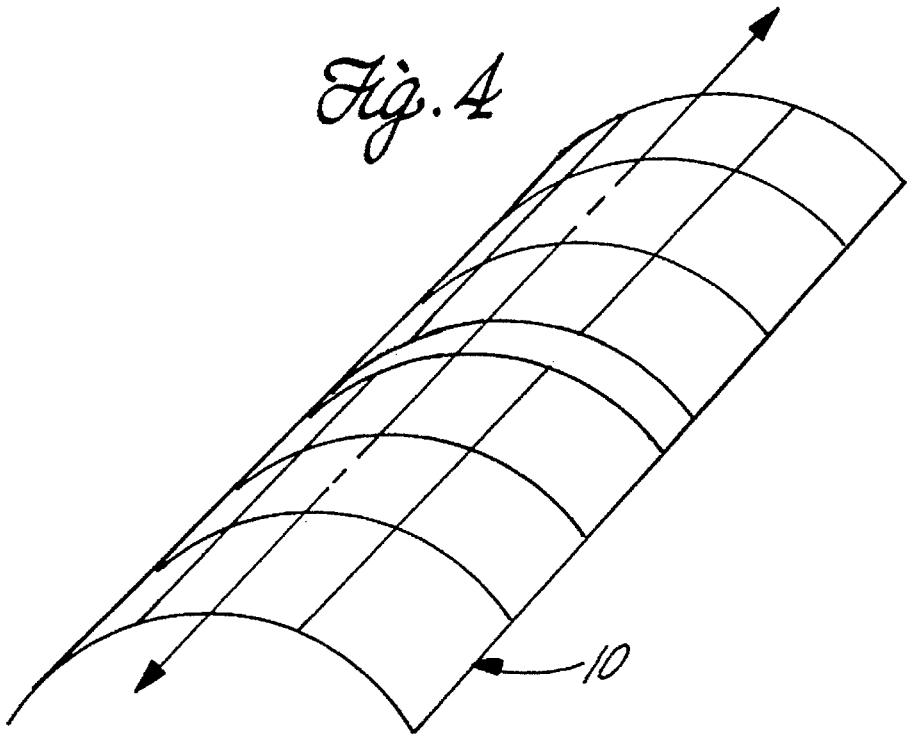
FIG. 4 illustrates long axis curl.

In the construction, and with reference to FIGS. 3 and 4, as contemplated for a United States market, the stamp has a width or short axis of about 2.6" and a length or long axis of 6.125". The width of each stamp in the direction of short axis is of 0.87" and the length of the stamp in the direction of the long axis, which is also the machine direction is 0.982".

As will be understood stamp and sheetlet dimensions will differ depending on the currency size of the country in which the sheetlets are sold as may be the number and the manner in which the array of stamps are configured as the facestock or backing of the sheetlet laminate.

We have found, however, that for ATM machines which dispense according to caliper or thickness, as long as the caliper of the construction is more than one half of the caliper of local currency the ATM machine will dispense single sheetlets. For those ATM machines which dispense by opacity the machine will dispense a single sheetlet if it is less opaque than a double layer of local currency. Stamp construction for the U.S. Market having a caliper of 4.5mils have been properly dispensed from ATM machines designed to dispense the currency of Singapore having a caliper of 6 mils.

The detail elements of the construction are depicted in FIG. 2. With reference thereto, an individual stamp assembly consists of a top coat of a polymer or varnish coating 22, preferably an acrylic coat which can be applied in a water borne system and when dry is receptive to cancellation inks and which preferably contains means to enable identification of the location of a stamp on an envelope in an automatic cancellation machine to determine if the envelope can be automatically cancelled or rejected for hand cancellation.

The preferred overcoat or topcoat 22 is applied as an aqueous acrylic blend containing zinc orthosilicate (Taggant). The presently preferred coating is manufactured and sold by Environmental Ink and Coating Corporation of Morganton, N.C. The coating 22 is applied to a paper layer 24 of about 56 g/m$^2$ weight. The coatings are preferably the same but may differ provided the coefficient of friction requirements of this invention are satisfied. The undersurface of the paper 24 is a coating of a water soluble primer 26 which allows thorough soaking for a period of no more than 30 minutes separation of the stamp face from the adhesive for stamp collector purposes. The next layer in the construction is an ooze resistant pressure sensitive adhesive 28, preferably applied as an acrylic emulsion, but which may also be hot melt coated or applied from a solvent.

The ooze resistant pressure sensitive adhesive has a storage modulus of greater than about 10,000 dynes/cm$^2$ at a deformation rate of $10^{-7}$ radians per second and is preferably an emulsion acrylic polymer as measured on a Rheometrics RDS-7700. The adhesive is in turn in contact with a release liner 30 having an undercoat 32 or surface of the same or different nature as the overcoat 22. Inclusion of the agent to enable stamp detection for cancellation purposes is not required. This is because the release liner is only a support for the stamps. It may, however, be printed with suitable graphics such as order forms, use instructions coupons and the like.

Requirement for the overcoat 22 and the undersurface 32 whether coated or not is that the surface have a static coefficient of friction, namely, the ratio of the force required to start moving a 193.3 gram sled divided by the weight of the sled across about 0.45, preferably between about 0.45 to about 0.7. This corresponds to 135 grams to a static face to imitate sled movement of about 87 grams to about 135 grams. It has been found that provided the friction requirements are met there should be at least a 25% difference between the coefficient of friction of the upper surface and the undersurface. This may be achieved by selection of paper or coatings as well as providing an irregular surface as by embossing or including in a coating fillers or the like. The difference of the coefficient of friction will greatly aid in ensuring single sheetlet dispersing.

Coating 22 and coating 32 or under also serve to stiffen the overall construction and aid in sealing the paper to prevent different expansion as between the stamps and release liner which encourages edge ooze of the adhesive. The rheological properties of the adhesive also serve to inhibit edge ooze.

Stamps are formed by die-cutting through coating 22, paper 24, primer 26, and adhesive 28 to release liner 30. The die-cuts are depicted as 34 in FIGS. 1 and 2. As indicated, varnish, however, must provide a coefficient of friction sufficiently high to enable single stamp sheetlet 10 to be dispensed by an automatic teller machine as opposed to dispensing multiple sheetlets 10.

Figure 5:
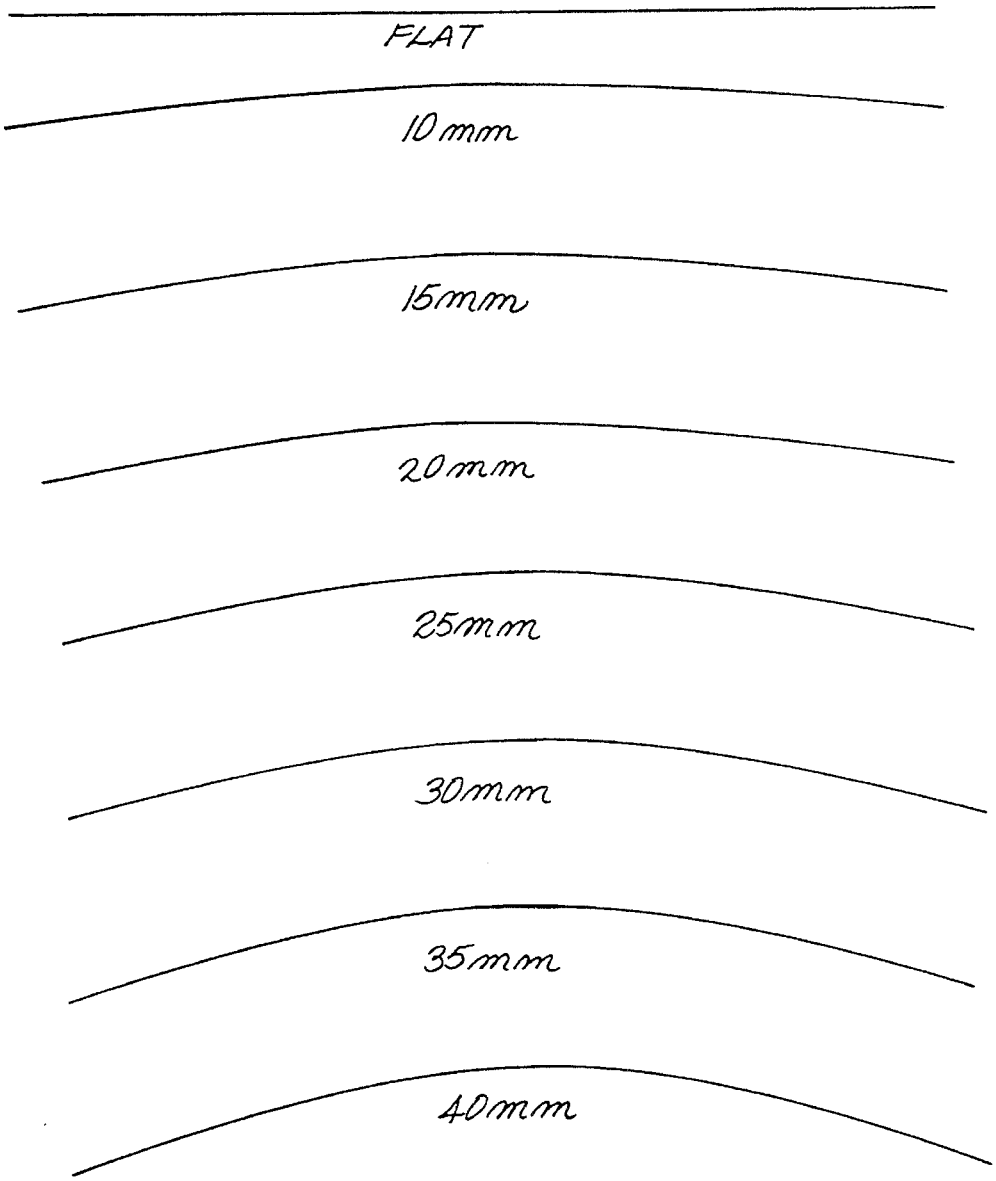
FIG. 5 illustrates the gauge used to determine curl.

To properly function in an automatic teller machine, with reference not to FIGS. 3, 4 and 5, the stamp sheetlet 10 must have, as manufactured, a curl no greater than 40 mm around either the short or the long axis. Curl is determined by holding a sheetlet 10 in the center of an edge and while the sheetlet hangs freely. The sheetlet is placed on the curl gauge depicted in FIG. 5 and if it has a curl greater than 40 mm it is rejected for purposed of dispensing in an automatic teller machine. Curl can be controlled by selection of materials of construction including coating as well as by using stagged slits in the release liner to reduce any tendency for curl, i.e. cause the release liner to conform to the stamps.

The overall caliper or thickness of the stamp sheetlet construction 10 is preferably between about 4.3 and 5 mils, preferably about 4.6 mils but in any event should be the design caliper thickness of the ATM which dispenses by caliper or design opacity for ATM machines which dispense by opacity.

Friction is determined by securing a sheetlet to a flat surface placing a 193.3 gram sled measuring 6"×20.25" on the sheetlet and pulling the sled with a force gauge to initiate movement of the sled over the sheetlet. The force measured is the force required to initiate movement of the sled over the sheetlet at a rate of 0.5 inch per minute.

For proper dispensing as measured by the static coefficient of friction of 0.45 to about 0.7 and coefficient of friction difference ensures preventing multiple dispensing of sheetlets from an automatic teller machine 120 with coefficient of friction differential between the preferred the upper and lower surfaces by about 25% or more.

The pressure sensitive adhesive employed in the instant invention is of a nature that it must be of sufficient tack at expected use temperatures and Table 1 below lists adhesive characteristics of the presently preferred adhesive. Such adhesive will enable initial repositionable bonding to a variety of paper substrates over the range expected use temperatures with bond growing to achieve a permanent bond of a level where the stamp cannot be removed from the paper substrate in the absence of paper tear.

TABLE 1

| | | | |
|---|---|---|---|
| Glass Transition (Tg), °C. | | | |
| Willaim' Plasticity (WPI), mm | | | 3.42 |
| Minimum Application Temp, | | | |
| °F. | | | 10 |
| °C. | | | −12 |
| Adhesive Coat Weight ($g/m^2$) | | | 24 |
| 10 minute 90° Peel (pli) | | Initial | 1.3 cl/Tear |
| | | 6 wk RT | 1.5 cl, leg |
| | | 6 wk 70° C. | 1.7 Tear |
| Looptack (pli) | | Initial | 1.8 clean |
| | | 6 wk RT | 2.4 clean |
| | | 6 wk 70° C. | 2.3 clean |
| Repositionability | | | Initial/6 wk RT |
| | Tyvek | 30 seconds | A/A |
| | | 60 seconds | A/A |
| | | 90 seconds | A/A |
| | | 1 hour | A/F |
| | Woven | 30 seconds | D/D |
| | | 60 seconds | NA |
| | | 90 seconds | NA |
| | | 1 hour | NA |
| | Bond | 30 seconds | D/D |
| | | 60 seconds | NA |
| | | 90 seconds | NA |
| | | 1 hour | NA |
| 1 Hour Performance | Tyvek | Initial | F |
| | | 6 wk RT | F |
| | Woven | Initial | D |
| | | 6 wk RT | D/F |
| | Bond | Initial | F |
| | | 6 wk RT | D/F |

Key for Repositioning and Permanence:
A = Clean
B = Slight substrate (envelope
C = Substrate pick
NA = Not Applicable
D = Substrate tear
E = Face pick
F = Face tear
G = Spot adhesive transfer The primer coat is of a nature which will allow the facestock of the stamp to be separated from the adhesive while still wet after soaking in water for 30 minutes and with slow peeling of the facestock of the stamp from the adhesive layer which stays with the envelope paper. At worst, if some adhesive stay with the stamp then a small amount of rubbing should enable removal of residual adhesive from the stamp.

While the stamp is still wet it should not feel tacky and if it retains adhesive, which cannot be easily removed from the stamp by rubbing off, the adhesive or by reimbursing the stamp in water, then the adhesive is unsuitable for overall stamp performance.

The stamp sheetlets of the instant invention are presently manufactured by forming a laminate of the release liner pressure sensitive adhesive and facestock. The face is imprinted with stamp graphics and, if desired, the undersurface may also be printed. Water borne inks are preferably used. This is followed by undercoating and overcoating with the water based acrylic coating with the overcoating preferably containing Taggant. The assembly is then die-cut to form the stamps and bar. Finally, the die cut and the assembly cut to the desired sheetlet size. It has been found, as indicated above, that the application of the overcoat and undercoat imparts sufficient stiffness to the assembly for the assembly to behave as currency, and in cooperation with adhesives having characteristics as specified herein, enables trouble free dispensing from an automatic teller machine. If desired the coating can be applied after die-cutting.

In use removal of the bar exposed the edges of the stamps for removal from the protective release liner.

What is claimed is:

1. An automatic teller machine postage stamp construction which comprises a sheetlet formed of:

(a) a currency sized paper release liner having a first top surface and an opposed first undersurface, said first undersurface providing a coefficient of friction of at least about 0.45;

(b) a plurality of die-cut stamps individually adhered by an ooze resistant pressure sensitive adhesive to the first top surface of the release liner, each of said stamps formed of a paper having a second top surface and an opposed stamp second undersurface, the second top surface being coated with a polymeric coating having a coefficient of friction greater than about 0.45, the stamp second undersurface providing a water soluble means to enable separation of stamps from the pressure sensitive adhesive by soaking in water, said pressure sensitive adhesive having a storage modulus greater than about 10,000 dynes/$cm^2$ at a deformation rate of $10^{-7}$ radian/second, said sheetlets have a curl no greater than 40 mm along any axis.

2. A postage stamp construction as claimed in claim 1 in which the paper forming each stamp has a paper weight of about 56 $g/m^2$ and the paper forming the release liner has a paper weight of about 50 $g/m^2$.

3. A postage stamp construction as claimed in claim 1 in which the pressure sensitive adhesive is an emulsion acrylic adhesive polymer.

4. A postage stamp construction as claimed in claim 1 in which the sheetlet has a thickness of from about 4.3 to about 5 mils.

5. A postage stamp construction as claimed in claim 1 in which the sheetlet has a thickness of about 4.6 mils.

6. A postage stamp construction as claimed in claim 1 in which the first undersurface of the release liner is coated with a polymeric coating.

7. A postage stamp construction as claimed in claim 6 in which the coating on the second top surface of each stamp and first undersurface of the release liner are acrylic based.

8. A postage stamp construction as claimed in claim 1 in which the coefficient of friction of the second top surface of the stamp and the coefficient of friction of first undersurface of the release liner differ by at least about 25%.

9. A postage stamp construction as claimed in claim 8 in which the first undersurface of the release liner is coated with a polymeric coating.

10. A postage stamp construction as claimed in claim 8 in which the paper forming each stamp has a paper weight of about 56 $g/m_2$ and the paper of the release liner has a paper weight of about 50 $g/m^2$.

11. A postage stamp construction as claimed in claim 1 in which the coating on the second top surface of each stamp contains means to detect location of the stamp on an envelope.

12. A postage stamp construction as claimed in claim 11 in which the paper forming each stamp has a paper weight of about 56 g/m$^2$ and the paper of the release liner has a paper weight of about 50 g/m$^2$.

13. A postage stamp construction as claimed in claim 11 in which the coefficient of friction of the second top surface of the stamp and the coefficient of friction of the first undersurface of the release liner differ by at least about 25%.

14. A postage stamp construction as claimed in claim 11 in which the means to detect the location of a stamp on an envelope is zinc orthosilicate.

15. A postage stamp construction as claimed in claim 14 in which the coefficient of friction of the second top surface of the stamp and the coefficient of friction of the first undersurface of the release liner differ by at least about 25%.

16. A postage stamp construction as claimed in claim 15 in which the paper forming each stamp has a paper weight of about 56 g/m$^2$ and the paper forming the release liner has a paper weight of about 50 g/m$^2$.

17. A postage stamp construction as claimed in claim 15 in which the first undersurface of the release liner is coated with a polymeric coating.

18. A postage stamp construction as claimed in claim 17 in which the paper forming each stamp has a paper weight of about 56 g/m$^2$ and the paper forming the release liner has a paper weight of about 50 g/m$^2$.

19. A postage stamp construction as claimed in claim 17 in which the coating on the second top surface of each stamp and first undersurface of the release liner are acrylic based.

20. A postage stamp construction as claimed in claim 19 in which the sheetlet has a thickness of about 4.6 mils.

21. A postage stamp construction as claimed in claim 19 in which the pressure sensitive adhesive is an emulsion acrylic adhesive polymer.

22. A postage stamp construction as claimed in claim 21 in which the sheetlet has a thickness of from about 4.3 to about 5 mils.

23. An automatic teller machine dispensable postage stamp construction which comprises a sheetlet formed of:

(a) a currency sized release liner formed of a paper having a paper weight of about 50 g/m$^2$, providing a first top surface and a first undersurface, the first undersurface of the release liner providing a coefficient of friction of from about 0.45 to about 0.7;

(b) a plurality of stamps individually adhered by an ooze resistant emulsion acrylic pressure sensitive adhesive to the first top surface release liner, each of the stamps formed of an ink cancelable acrylic coating applied to a second top surface of paper having a paper weight of about 56 g/m$^2$, said acrylic coating on the second top surface having a coefficient of friction of from about 0.45 to about 0.7 and containing zinc orthosilicate present in a concentration sufficient to enable detection of a stamp location on an envelope by a stamp cancellation machine, said paper further having, on a second undersurface opposed of the second top surface, a water soluble primer in contact with the pressure sensitive adhesive, said pressure sensitive adhesive being an emulsion acrylic polymer having a storage modulus of at least 10,000 dynes/cm$^2$ at a deformation rate of $10^{-7}$ radians/second, said postage stamps being formed by die-cutting a laminate of top coating, paper, primer and pressure sensitive adhesive to said release liner, said construction have a thickness of from about 4.3 to about 5 mils and a curl no greater than 40 mm.

24. A postage stamp construction as claimed in claim 23 in which the coefficient of friction of the second top surface of the stamp and the coefficient of friction of the first undersurface of the release liner differ by at least about 25%

25. A postage stamp construction as claimed in claim 23 in which the first undersurface of the release liner is coated with a polymeric coating.

26. A postage stamp construction as claimed in claim 23 in which the total construction has a thickness of about 4.6 mils.

27. A postage stamp construction as claimed in claim 26 in which the coefficient of friction of the second top surface of the first stamp and the coefficient of friction of the undersurface of the release liner differ by at least about 25%.

28. A postage stamp construction as claimed in claim 27 in which the first undersurface of the release liner is coated with a polymeric coating.

* * * * *

UNITED STATES PATENT AND TRADEMARK OFFICE

CERTIFICATE OF CORRECTION

PATENT NO. : 5,503,436

DATED : April 2, 1996

INVENTOR(S) : Alpaugh, et. al.

It is certified that error appears in the above-indentified patent and that said Letters Patent is hereby corrected as shown below: Title page, ABSTRACT, line 4, before "coated" insert -- is --.
ABSTRACT, line 4, after "coating" change "of" to -- on --.
ABSTRACT, line 6, before "dispensable" insert -- is --.
Column 1, line 36, before "only" replace "no" with "not".
Column 2, line 32, change "purposed" to -- purposes --.
Column 3, line 3, change "Drawing" to -- drawing, --.
Column 3, line 8, after "number" insert a comma.
Column 3, line 39, change "4.5mils" to -- 4.5 mils --.
Column 3, line 44, change "detail" to -- detailed --.
Column 4, line 10, after "instructions" insert a comma.
Column 4, line 14, change "surface" to -- surfaces --.
Column 4, line 41, after "reference" delete "not".
Column 4, line 45, after "edge" delete "and".
Column 4, line 48, change "purposed" to -- purposes --.

UNITED STATES PATENT AND TRADEMARK OFFICE

CERTIFICATE OF CORRECTION

PATENT NO. : 5,503,436

DATED : April 2, 1996

INVENTOR(S) : Alpaugh; Birnbaum; Fung; Green; Macuga; Mingus; Padilla; Peng; Fatha; Kumar It is certified that error appears in the above-indentified patent and that said Letters Patent is hereby corrected as shown below:

Column 5, line 3, after "preferred" delete "the".
Column 5, line 16, in the third column of table I after "Glass Transition (Tg), °C." insert -- -38 --.
Column 5, line 17, Page 10, in the first column of Table 1, change "Willaim' to -- William's --.
Column 5, line 47, change "(envelope" to -- (envelope) --.
Column 5, line 57, change "stay" to -- stays --.
Column 5, line 62, after "off" delete the comma.
Column 6, line 64, change "56 $g/m_2$" to -- 56 $g/m^2$ --.
Column 8, line 29, after "25%" insert a period.

Signed and Sealed this

Sixth Day of May, 1997

*Attest:*

*Attesting Officer*

BRUCE LEHMAN

*Commissioner of Patents and Trademarks*